United States Patent [19]

Arnold

[11] 4,149,603

[45] Apr. 17, 1979

[54] RISERLESS MUD RETURN SYSTEM

[76] Inventor: James F. Arnold, 6440 Hillcroft, Houston, Tex. 77036

[21] Appl. No.: 830,986

[22] Filed: Sep. 6, 1977

[51] Int. Cl.[2] ..... E21B 15/02

[52] U.S. Cl. ..... 175/7; 166/368; 175/25; 175/38; 175/217

[58] Field of Search ..... 175/5, 7, 8, 9, 10, 175/25, 38, 209, 210, 207, 217, 315; 166/0.5, 0.6, 340, 359, 357, 368; 37/56; 299/8

[56] References Cited

U.S. PATENT DOCUMENTS

| | | | |
|---|---|---|---|
| 1,811,761 | 6/1931 | Roberts | 166/0.5 |
| 2,534,480 | 12/1950 | Shannon | 175/8 |
| 2,937,006 | 5/1960 | Thayer | 175/8 X |
| 3,252,529 | 5/1966 | Fischer | 175/7 |
| 3,260,004 | 7/1966 | Brooks | 166/0.5 |
| 3,498,674 | 8/1970 | Matthews | 175/209 X |
| 3,603,409 | 9/1971 | Watkins | 175/7 |
| 3,612,176 | 10/1971 | Bauer et al. | 166/359 |
| 3,902,553 | 9/1975 | Jergins | 166/0.5 |
| 3,971,593 | 7/1976 | Porte et al. | 299/8 |
| 4,030,216 | 6/1977 | Willums | 299/8 |
| 4,060,140 | 11/1977 | Barrington | 166/0.5 X |

*Primary Examiner*—Stephen J. Novosad
*Assistant Examiner*—Richard E. Favreau

[57] ABSTRACT

A system and method are disclosed which eliminates the use of a riser pipe in underwater drilling operations. The system includes a mud sump connectable to the top of a submerged wellhead and has a bottom with a mud inlet provided therein and an upwardly extending wall cooperating with the bottom to support a quantity of mud, the sump restricting the water to contact with only the upper surface of the mud as the mud passes upwardly through the mud inlet in the bottom. A hose, separate from the drill string, is used to carry mud to the surface of the water. A pumping means is used to pump mud through the hose in response to the quantity of mud supported within the sump to thereby return the mud to the surface of the water without the use of a riser pipe.

18 Claims, 2 Drawing Figures

RISERLESS MUD RETURN SYSTEM

The use of marine risers or riser pipes in underwater drilling operations is well known. Normally, these risers are links of special casing which are joined by connectors and extend from the drilling station, such as a drilling platform or drilling ship, to the top of the wellhead, such as a blowout preventor (BOP) stack. The riser is installed after the BOP stack has been set on the sea floor drilling template and the drill string passes through the riser and the BOP stack into the subsea geological formations for drilling operations.

There are basically two functions performed by a riser. The first function is to act as a conduit for carrying cutting laden drilling mud from the BOP stack up to the drilling station. The drilling mud is then processed, such as by conventional mud filtering, and reused in the drilling operations. The second function of the marine riser is to guide the drill string back into the wellhead after the drill string has been removed from the bore hole such as for changing the bit.

One of the major problems associated with these marine risers is caused by the cross-currents in the waters. Because the riser pipe has a relatively large diameter, the cross-currents generate substantial forces radially to the diameter of the pipe. Thus, stresses develop in the pipe which means that expensive materials are used so that these stresses can be withstood. Also, because the pipe is relatively inflexible, the cross-currents generate substantial side forces on the wellhead which can cause damage to the wellhead. To solve these problems, expensive and complicated heave compensation systems, station keeping systems and ball joints connecting the riser to the wellhead are used.

Also, in deep water drilling, the riser pipe is quite long which makes it extremely heavy. This causes additional problems in the heave compensation systems, station keeping systems and the ball joints. To solve this problem, expensive buoyancy systems have been worked out which further increases the cost of the riser pipe.

Another problem associated with these risers is caused by adverse weather conditions. Because the riser is a rigid structure which must be dismantled and drawn up through the moon pool of a drilling ship, it causes the ship to be on or near the well site for extended periods of time in situations where the time could be better spent in moving to a safe area. This problem was recognized by W. J. Hayes in U.S. Pat. No. 3,215,454, wherein the solution was to provide remotely actuated apparatus for connecting the lower end of a riser pipe to a wellhead. Moreover, it was mentioned in said patent that one method in drilling deep wells was to use a wellhead assembly closed at the top by a circulation head. A flexible hose runs from the head back to the drilling vessel on the surface so that the mud is returned to the surface via the hose. This construction, however, has the inherent difficulty of providing a seal around the drill string to prevent the passage of the water into the circulation head and mud out of the circulation head into the surrounding water.

Accordingly, it is a primary object of the present invention to provide a system and method of underwater drilling operations which returns drilling mud to the surface of the water without using a riser pipe.

Another object of the present invention is to provide a guide template to guide a drill string down into alignment with a submerged wellhead without using a riser pipe.

Another object of the present invention is to provide a system and method of underwater drilling operations which does not use a riser pipe and thereby is less critical to the change in position of a drilling station relative to a wellhead in the drilling operations.

Another object of the invention is to provide a method and system of underwater drilling operations which is affected less by cross-current of the water than a system using a riser pipe.

Another object of the invention is to provide a system and method of underwater drilling operations which is lighter in weight than a riser pipe.

Another object of the invention is to provide a system and method of underwater drilling operations which may be used readily separated from the wellhead for storage on a drilling station to aid in quickly moving a drilling station to a safe location in times of inclement weather.

In accordance with the invention, a system and method are disclosed for use in underwater drilling operations. The system is used to return drilling mud to the surface of the water and guide a drill string to a wellhead during drilling operations. The system employs a mud sump connectable to the top of a submerged wellhead with the sump having a bottom with a mud inlet provided therein and an upwardly extending wall cooperating with the bottom to support a quantity of mud, the sump restricting the water to contact with only the upper surface of the mud as the mud passes upwardly through the mud inlet in the bottom. A hose, separate from the drill string, is used for carrying mud to the surface of the water. A means is used for pumping mud through the hose in response to the quantity of mud supported within the sump to thereby return the mud to the surface of the water without the use of a riser pipe.

Other objects and advantages will become apparent upon reading the following detailed description and upon reference to the drawings, in which like reference numerals are used throughout to designate like parts:

While the invention will be described in connection with a preferred embodiment and procedure, it will be understood that it is not intended to limit the invention to that embodiment and procedure. On the contrary, it is intended to cover all alternatives, modifications and equivalents as may be included within the spirit and scope of the invention as defined by the appended claims.

Figure 1:
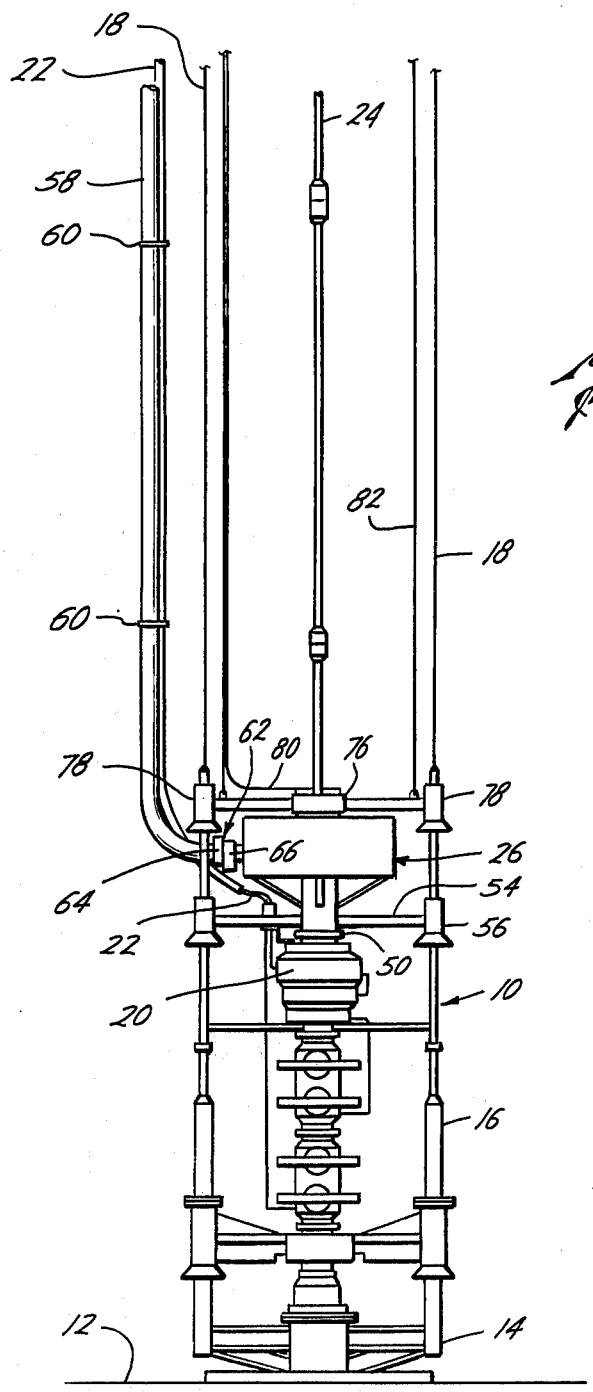
FIG. 1 is an elevational view of an embodiment constructed according to the present invention connected to a submerged wellhead.

Turning first to FIG. 1, there is shown a conventional wellhead 10 positioned on a sea floor 12. Wellhead 10 uses a guide base 14 having guide posts 16 extending upwardly therefrom with guidelines 18 leading to the surface of the water. A BOP stack 20 is connected to guide base 14 and has hydraulic control lines 22 leading from a drilling station (not shown) to a control plate.

As shown, a conventional drill string 24 extends from the drilling station down into the bore of wellhead 10. During drilling operations the drilling mud moves downwardly within drill string 24 into the bore hole and then upwardly around string 24 to wellhead 10.

Figure 2:
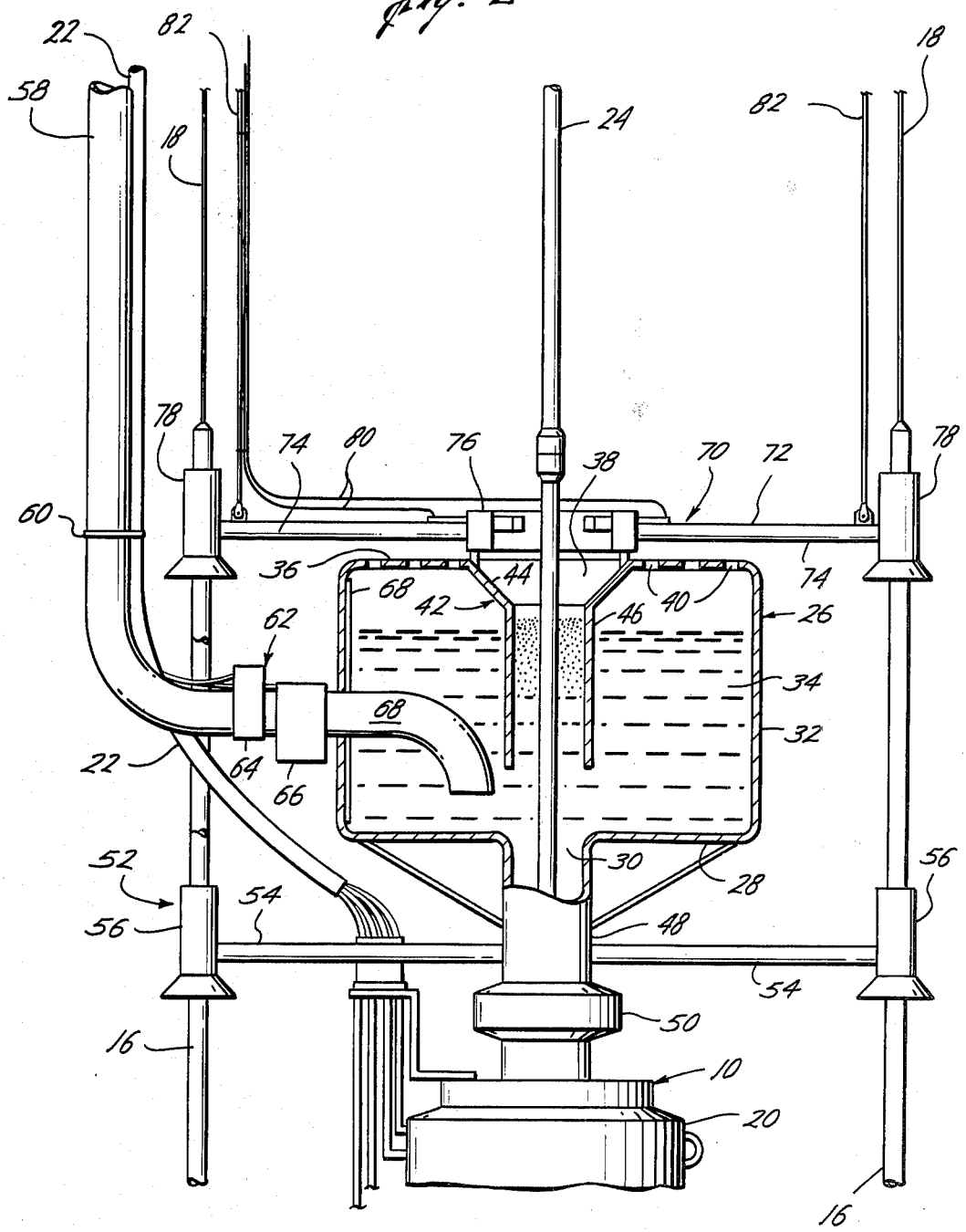
FIG. 2 is an enlarged elevational view, partly in section, of the embodiment of the invention shown in FIG. 1.

As best shown in FIG. 2, a mud sump 26 is connected to the top of submerged wellhead 10 and has a bottom 28 with a mud inlet or hole 30 provided therein. An upwardly extending side 32 coacts with bottom 28 to support a quantity of drilling mud 34 and restrict the water to contact with the upper surface of the quantity of mud 34. Thus, as drilling mud passes downwardly through drill string 24, it returns to mud sump 26 via mud inlet 30 to displace water within sump 26. Preferably, wall 32 of sump 36 is tubular and concentrically disposed around mud inlet 30.

A top 36 may be provided for sump 26 on walls 32 which protects sump 26 from having objects contaminate the mud from the surrounding water. An opening 38 is provided within top 36 to permit the access of drill string 24 to mud inlet 30. Further, a plurality of openings 40 may be provided within top 36 to permit the free passage of water into and out of sump 26.

A drill string passageway 42 may be added to sump 26 which leads from opening 38 in top 36 toward inlet 30 in bottom 28. Passageway 42 is funnel-shaped with a conical portion 44 connected to top 36 concentrically around opening 38 to aid in guiding drill string 24 to inlet 30 and with a tubular portion 46 extending downwardly toward inlet 30 to localize any turbulence within the passageway caused by rotating drill string 24.

Mud sump 26 may be connected to the top of the BOP stack 20 by using a conduit 48 extending downwardly from bottom 28 which aligns inlet 30 with the bore of wellhead 10. A means 50 is attached to the bottom of conduit 48 for connecting sump 26 to BOP stack 20. Although means 50 may be of any conventional design, it is preferably that type structure used in connecting the bottom of a marine riser to BOP stack 20.

A frame 52 is used to support sump 26 and align inlet 30 with the bore of wellhead 10 upon arrival of frame 52 at the wellhead. Frame 52 has arms 54 attached to sump 26 and a bell guide 56 attached to each arm for sliding down guidelines 18.

A hose 58 is used to carry drilling mud from sump 26 to the surface of the water. Hose 58 is separate from the drill string meaning that such hose is not disposed around the drill string, but apart from the drill string so that the drilling mud can be carried to the surface of the water. Since hose 58 is of less diameter than a riser pipe, less force will be exerted on the hose by the cross-currents. Preferably, hydraulic line 22 is attached to hose 58 with straps 60 so that these hoses may be withdrawn together in an effort to increase the speed of disconnection from wellhead 10 in case of inclement weather.

A means 62 is used to pump mud through hose 58 in response to the quantity of mud supported within sump 26. Pumping means 62 is, preferably, an in-line pump 64 having an inlet leading into sump 26 and an outlet leading into hose 58. Pumping means 62 may also include an in-line servo-operated valve 66 which permits the passage of mud down hose 58 into mud sump 26 and from there down inlet 30 into the bore of wellhead 10 when mud is added to the well. Preferably, the inlet into pumping means 62 includes an elbow 68 extending through wall 32 of sump 26 with an inlet in relatively close proximity to bottom 28 to aid in withdrawing the mud without mixing water therewith.

Although pumping means 62 may remove a continuous volume of mud from sump 26, it is preferred that pumping means 62 be controlled by level sensors 68 positioned on the interior surface of side 32. Thus, when the mud level reaches a certain height within sump 26, pumping means 62 is activated to remove mud until the level is lowered to a point which causes pumping means 62 to stop operating.

In operation, mud sump 26 is positioned on submerged wellhead 10 so that the mud inlet 30 in the bottom 28 is aligned with the bore and wellhead 10. Mud flows down drill string 24, which extends through inlet 30 in bottom 28, into the bore of wellhead 10. Water is displaced from sump 26, as the drilling mud is received from the inlet 30, and a quantity of the received drilling mud is supported within sump 26. The mud is then pumped from sump 26 through hose 58 to the surface of the water and thereby return the drilling mud to the surface of the water without using a riser pipe.

When drill string 24 has been withdrawn from the bore hole, a guiding template 70 is used to align drill string 24 with the bore hole upon return of the drill string to wellhead 10. Guidance template 70 includes a framework 72 which is constructed for resting on top of mud sump 26 and includes arms 74 extending outwardly from a clamp 76 and a bell-shaped guide 78 is attached at the end of each arm.

Clamp 76 closes on drill string 24 at the surface of the water and releases drill string 24 when aligned with the bore in wellhead 10. Clamp 76 is of any conventional design which will operate in submerged conditions, but preferably the clamp is of a hydraulic piston type so that the jaws of clamp 76 will be activated by applying hydraulic fluid through line 80.

Guides 78 are constructed to slide down guidelines 18 and over guide posts 16. Guides 78 are provided on framework 74 to coact with clamp 76 in aligning drill string 24 relative to the bore upon arrival of framework 72 at wellhead 10.

Retrieving lines 82 are attached to arms 72 for raising and lowering guidance template 70 along guidelines 18. Thus, guidance template 70 can be removed from wellhead 10 independently of drill string 24.

From the foregoing it will be seen that this invention is one well adapted to attain all of the ends and objectives hereinabove set forth, together with other advantages which are obvious and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof. It is to be understood that all matter herein set forth or shown in the accompanying drawings is to be interpreted as illustrious and not in a limiting sense.

What is claimed is:

1. A system used in underwater drilling operations for returning drilling mud to the surface of the water, comprising a mud sump connectable to the top of a submerged wellhead and having (i) a bottom with a mud inlet provided therein, and (ii) an upwardly extending side coacting with the bottom to support a quantity of drilling mud, and means for placing the water in continuous contact with the upper surface of the mud as the mud passes upwardly through the mud inlet in the bottom during drilling operations, a hose separate from the drill string for carrying drilling mud to the surface of the water, and means for mechanically pumping the mud through the hose in response to the quantity of mud supported within the sump to thereby return the mud to the surface of the water without the use of a riser pipe.

2. The system of claim 1, wherein said mud sump has a conduit extending downwardly from the bottom for aligning the mud inlet therein with the bore of the wellhead and means attached to the conduit for connecting the sump to the wellhead.

3. The system of claim 1, including a frame supporting said sump to align the mud inlet in the bottom with the bore of the wellhead, said frame having arms and guides attached to the arms for sliding down guide lines attached to the wellhead.

4. The system of claim 1, wherein said mud pumping means includes a level sensor provided in the sump to activate and deactivate the mud pumping means in response to the quantity of mud supported in the container.

5. The system of claim 1, wherein said sump has a top with a drill string opening provided therein to permit access of the drill string to the mud inlet in the bottom.

6. The system of claim 5, wherein the top has a plurality of openings provided therein to permit passage of water into and out of said sump.

7. The system of claim 5, wherein said mud sump includes a drill string passageway leading from the drill string opening in the top toward the mud inlet in the bottom, the passageway being funnel-shaped with a conical portion connected to the top concentrically around the drill string opening to aid in guiding the drill string to the mud inlet and with a tubular portion extending downward toward the mud inlet to localize turbulence from operation of the drill string to within the passageway.

8. The system of claim 7, wherein the wall of said sump is tubular and concentrically disposed around the mud inlet in the bottom.

9. The system of claim 8, wherein the top has a plurality of openings provided therein to permit passage of water into and out of said sump.

10. The system of claim 1, wherein said pumping means includes an in-line pump with an inlet leading into said sump and an outlet leading into said hose.

11. The system of claim 10, wherein said pumping means includes an in-line servo-operated valve to permit the passage of mud from said hose into said mud sump and through the mud inlet in the bottom into the bore of the wellhead when it is necessary to add mud to the well.

12. The system of claim 1, including a guidance template for guiding a drill string down into alignment with the mud inlet in the bottom which aligns the drill string for insertion into the bore of the wellhead.

13. The system of claim 12, wherein said guidance template has a framework, a clamp adapted to close on the drill string at the surface of the water and release the drill string when aligned with the mud inlet, and guides adapted to slide down guide lines attached to the wellhead, the guides and clamp being provided in the framework such that the drill string is aligned with the hole when the framework arrives at the wellhead.

14. A method of eliminating a riser pipe in underwater drilling operations, comprising the steps of positioning a mud sump having a mud inlet in the bottom over a bore of a submerged wellhead, flowing drilling mud down through a drill string extending through the mud inlet in the bottom of the mud sump into the bore, displacing water from the sump with drilling mud received through the mud inlet in the bottom of the container, supporting a quantity of the received drilling mud in the sump, causing the upper surface of the received mud to be continuously in contact with the water during drilling operations, and mechanically pumping mud from the mud sump through a hose separate from a drill string to the surface of the water to thereby return drilling mud to the surface of the water without using a riser pipe.

15. The method of claim 14, including the steps of clamping the drill string to a guidance template at the surface of the water, guiding the drill string into alignment with the mud inlet of the sump by sliding the template down guide lines attached to the wellhead, and unclamping the drill string from the template for movement through the mud inlet in the sump into the wellhead bore.

16. A system used in underwater drilling operations for returning drilling mud to the surface of the water, comprising a mud sump connectable to the top of a submerged wellhead having a bottom with a mud inlet provided therein and an upwardly extending side coacting with the bottom to support a quantity of drilling mud and restrict the water to contact with only the upper surface of the mud as the mud passes upwardly through the mud inlet in the bottom, a hose separate from the drill string for carrying drilling mud to the surface of the water, means for pumping the mud through the hose, and a level sensor provided in the sump to activate and deactivate the mud pumping means in response to the quantity of mud supported in the container to thereby return the mud to the surface of the water without the use of a riser pipe.

17. The system of claim 16, wherein said pumping means includes an in-line pump with an inlet leading into said sump and an outlet leading into said hose.

18. The system of claim 17, wherein said pumping means includes an in-line servo-operated valve to permit the passage of mud from said hose into said mud sump and through the mud inlet in the bottom into the bore of the wellhead when it is necessary to add mud to the well.

* * * * *